US006247709B1

(12) United States Patent
Couderc

(10) Patent No.: US 6,247,709 B1
(45) Date of Patent: Jun. 19, 2001

(54) DEVICE FOR RETAINING A BOOT ON A GLIDING BOARD

(75) Inventor: Bernard Couderc, Annecy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/238,581

(22) Filed: Jan. 28, 1999

(30) Foreign Application Priority Data

Jan. 30, 1998 (FR) ..... 98 01265

(51) Int. Cl.[7] ..... B62B 13/00

(52) U.S. Cl. ..... 280/14.2; 280/617; 280/607; 280/618

(58) Field of Search ..... 280/14.2, 617, 280/618, 607, 636; 403/348, 350

(56) References Cited

U.S. PATENT DOCUMENTS 3,689,094 * 9/1972 Marker et al. ..... 280/636
3,887,205 * 6/1975 Edmund ..... 280/636
3,944,238 * 3/1976 Weigl et al. ..... 280/636
5,503,900 * 4/1996 Fletcher ..... 280/636
5,564,728 * 10/1996 Renaud-Goud ..... 280/636
5,660,493 * 8/1997 Stephens ..... 403/348
5,879,019 * 3/1999 Mantel ..... 280/636
5,909,894 * 6/1999 Meader et al. ..... 280/636
6,045,149 * 4/2000 Chonier et al. ..... 280/636

FOREIGN PATENT DOCUMENTS

WO97/04843 2/1997 (WO) .

* cited by examiner

*Primary Examiner*—Michael Mar
*Assistant Examiner*—Hau Phan
(74) *Attorney, Agent, or Firm*—Greenblum & Bernstein, P.L.C.

(57) ABSTRACT

A device for retaining a boot on a gliding board having a base with an upper surface and a lower surface, at least one cavity being provided in the thickness of the base between the upper surface and the lower surface to house a pad. The pad projects at least partially with respect to the upper surface when it is housed in the cavity. The device has an arrangement allowing a removable fastening of the pad in the cavity.

16 Claims, 3 Drawing Sheets

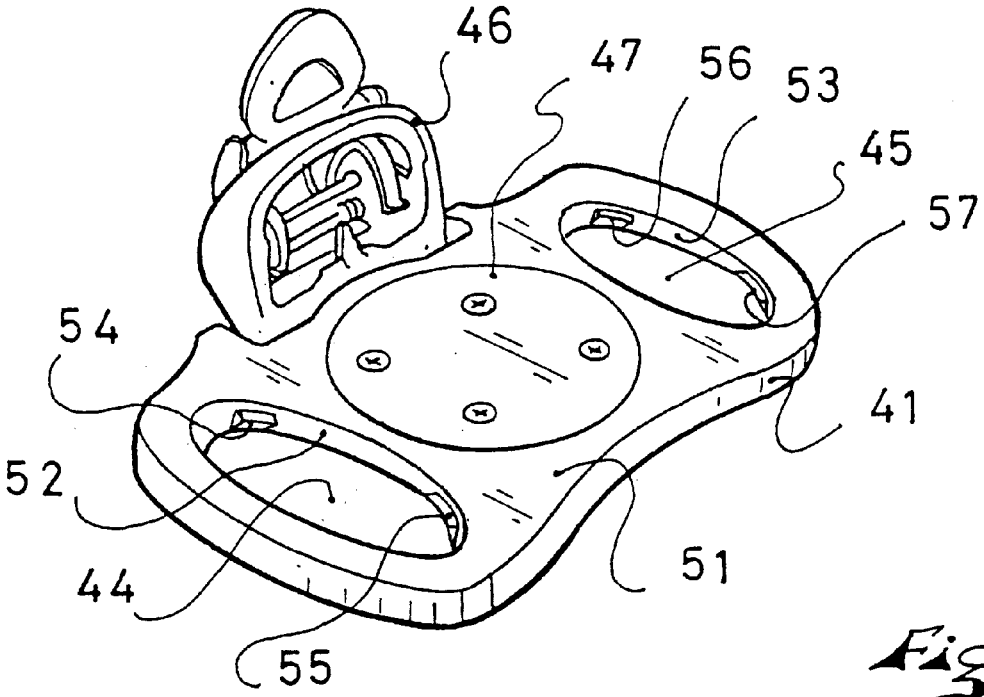
Fig:5
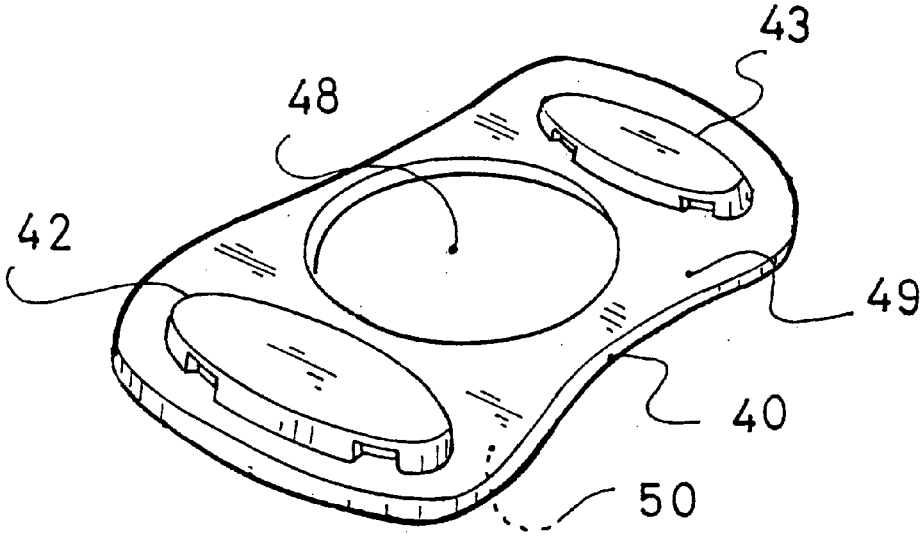

DEVICE FOR RETAINING A BOOT ON A GLIDING BOARD

BACKGROUND OF THE INVENTION

1. Field of the Invention

The present invention relates to the field of devices for retaining a boot on a gliding board, and particularly to devices used for snowboarding.

2. Description of Background and Relevant Information

Snowboarding is generally done with a board and boots retained on the board by retaining devices.

Certain devices have a base, provided to be affixed to the board, and means for retaining the boot on the base.

Pads, housed in cavities of the base so as to touch the sole of the boot, allow absorbing impacts related to the steering of the board. The structures of the pads and cavities are such that each pad is retained in a cavity by the board when the base is affixed to the board. When the base is detached from the board, each pad can be removed from its receiving cavity.

The removability of the pads facilitates their replacement when they are worn out but hinders the operations of mounting, adjusting or maintaining the devices.

This problem is particularly perceptible by the people whose occupation is to rent gliding boards to users, since these people must frequently handle the retaining devices to adjust and maintain them.

To overcome this problem, the pads are glued in the cavities. It then becomes difficult and tedious to replace them when they are worn out.

SUMMARY OF THE INVENTION

An object of the invention is a retaining device on which at least one pad can be removably retained without it being difficult or tedious to change it.

To this end, the invention proposes a device for retaining a boot on a gliding board, the device including a base which has an upper surface provided to receive the boot sole, and a lower surface provided to take support on the board, at least one cavity being provided in the thickness of the base between the upper surface and the lower surface to house a pad, the pad projecting at least partially with respect to the upper surface when it is housed in the cavity.

The device includes a means allowing a removable fastening of the pad on the base in the cavity.

This arrangement makes changing the pad easy and quick. Further, it is also easy to mount, adjust or maintain the device.

BRIEF DESCRIPTION OF DRAWINGS

Other characteristics and advantages of the invention will be better understood from the following description, with reference to the attached drawings that show, by way of a non-limiting example, how the invention can be embodied, and in which:

FIG. 5 is an exploded perspective view of a device according to an alternate embodiment of the invention.

DETAILED DESCRIPTION OF THE INVENTION

An example of an embodiment of the invention is described with regard to FIGS. 1–4.

Figure 1:
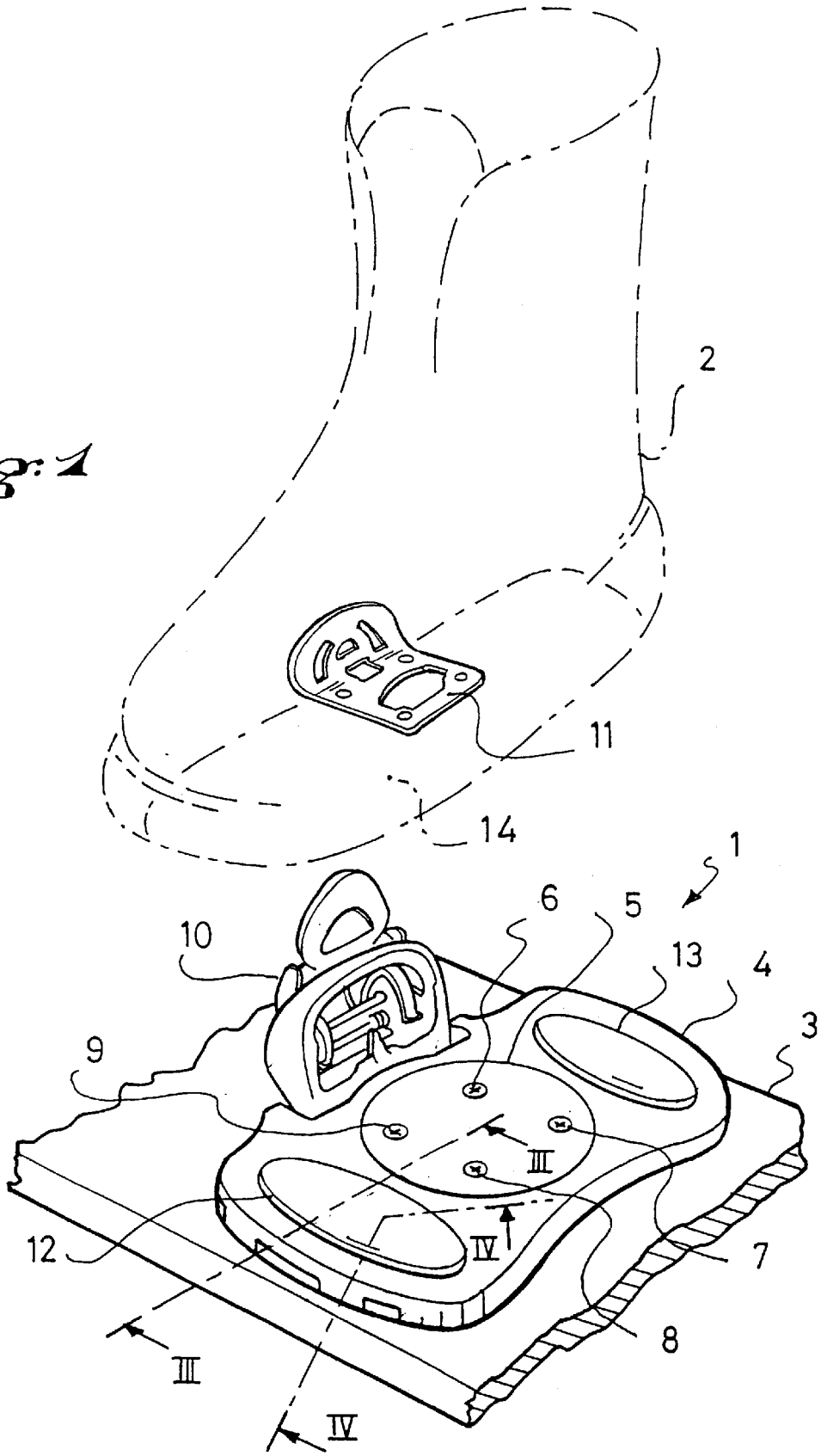
FIG. 1 is a perspective view of a device according to the invention.

A retaining device 1, seen in FIG. 1, allows retaining a boot 2 on a board 3.

The device 1 has a base 4 retained on the board 3 by a retaining arrangement, well known to one skilled in the art, shown in the form of a disk 5 and screws 6, 7, 8, 9. The board 3 is shown only partially for reasons of convenience.

A retaining mechanism 10 is affixed to the base 4 to retain the boot 2 on the base 4.

The retaining mechanism 10 is shown in the form of a structure that allows a removable fastening of an anchoring means 11, itself affixed to the boot 2 by an appropriate means.

It follows that the boot 2, shown in dotted lines for better understanding, can be removably retained on the base 4.

The retaining mechanism 10 and the boot 2 associated to the anchoring means 11 are known from document FR 96 13158, the disclosure of which is hereby expressly incorporated by reference thereto in its entirety and will not be described in further detail here.

The device 1 has front 12 and rear 13 pads provided to touch the sole 14 of the boot 2 when the latter is retained on the base 4.

Figure 2:
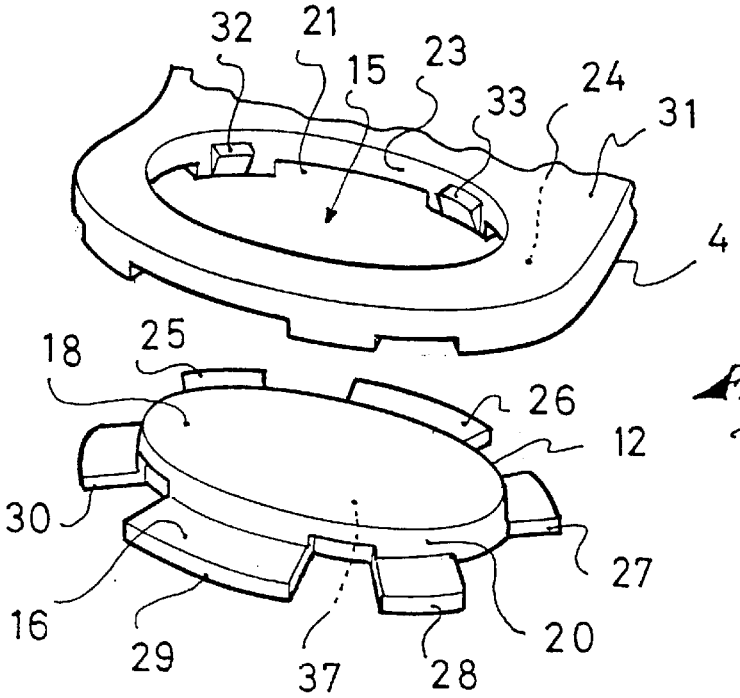
FIG. 2 is an exploded perspective view of a part of the device.
Figure 3:
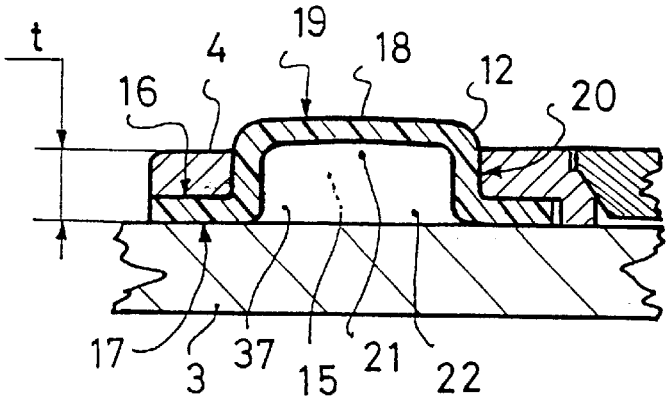
FIG. 3 is a cross-section taken along the line III—III of FIG. 1.
Figure 4:
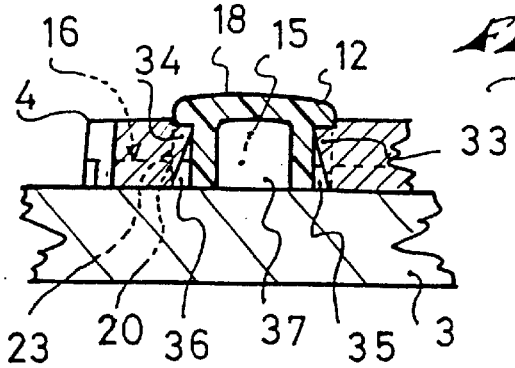
FIG. 4 is a cross-section taken along line IV—IV of FIG. 1.

The pads 12, 13 are removably retained on the base 4, as understood better from FIGS. 2, 3, and 4.

The partial perspective view of FIG. 2 shows that the pad 12 can be introduced in a cavity 15 of the base 4 to be retained in the cavity 15.

As better understood from FIG. 3, the pad 12 has the shape of a plate or flange, having an upper surface 16 provided to touch the base 4, and a lower surface 17 provided to touch the board 3.

A boss 18 projects from the upper surface 16 of the plate, (or flange) the boss 18 having a contact surface 10 provided to contact the boot 2, and a peripheral edge or side 20 connecting the contact surface 19 to the upper surface 16.

The cavity (or opening) 15 extends through the thickness t of the base 4, the cavity (or opening) 15 having an upper portion 21 which receives the boss 18 of the pad 12, and a lower portion 22 which receives the plate of the pad 12.

As better understood also from FIG. 2, the upper portion 21 of the cavity (or opening) 15 has a an inner peripheral edge 23 whose length is substantially equal to the length of the peripheral edge (or side) 20 of the boss 18 of the pad 12.

Thus, the pad 12 can be introduced into the cavity (or opening) 15 on the side of a lower surface 24 of the base 4, the surface 24 being provided to take support on the board 3. Portions (or tabs 25, 26, 27, 28, 29, 30 of the plate, (or flange) demarcating the upper surface 16, prevent any displacement of the pad 12 in a direction going from the lower surface 24 towards an upper surface 31 of the base 4.

A displacement of the pad 12 with respect to the base 4, in any direction substantially parallel to the upper surface 31, is prevented by the contact of the peripheral edge (or side) 20 inner with the peripheral edge 23.

Fastening means oppose a displacement of the pad 12 with respect to the base 4 in a direction going from the upper surface 31 towards the lower surface 24, i.e., in an unfastening direction of the pad 12 with respect to the base 4.

These fastening means are shown in the form of bosses, or protrusions such as the bosses 32, 33, that project with respect to the peripheral edge 23 of the upper portion 21 of the cavity or opening 15.

The interaction of the bosses or protrusions of the inner peripheral edge 23 with the pad 12 is shown in FIG. 4. In this figure, bosses or protrusions 33 and 34 of the edge 23 are housed in notches 35, 36 for receiving the bosses 33, 34, respectively, the notches 35, 36 being provided in the peripheral edge or side 20 of the pad 12.

The housing of the bosses or protrusions 33, 34 in the notches 35, 36 is possible due to the nature of the constitutive materials of the base 4 and of the pads 12, 13.

The base 4 is made of a relatively rigid material, i.e., a material that is hardly deformed under the action of forces exerted by a user during the steering of the board 3. A metallic alloy or plastic material, reinforced or non-reinforced, such as a glass fiber reinforced polyamide, is quite suitable.

The pads 12, 13 are made of a relatively flexible material, i.e., a material that can deform when a manual pressure is exerted on it and which takes on its initial form when the pressure is removed.

Thus, as understood from FIGS. 2, 3, 4, the pad 12 is manually nested into the cavity (or opening) 15 when the device 1 is not retained on the board 3.

It suffices to pass the boss 18 through the cavity (or opening) 15 until the upper surface 16 of the pad 12 touches the base 4. Thereafter, the bosses to protrusions 33, 34 are housed in the notches 35, 36 and hold the pad 12 in place on the base 4. It is then easy to manipulate the device 1 without losing the pad. The operations of mounting, dismounting, maintaining or adjusting the device are facilitated.

Separating the pad 12 from the base 4 is easily done when the device 1 is not retained on the board 3. It suffices to manually push the boss 18 so as to distance the upper surface 16 of the pad 12 from the base 4. This operation is easily done due to the flexibility of the constitutive material of the pad 12. The flexibility of the pad 12 is increased by the presence of a cavity 37 of the pad 12 that opens out on the lower surface 17.

The advantage is that the replacement of the pad 12 is very easy and very quick.

Of course, as shown in FIG. 3, for example, the pad 12 cannot exit the cavity (or opening) 15 when the device 1 is retained on the board 3. Thus, the pad 12 can absorb impacts from the boot 2 on the base 4.

The invention is not limited to the previously described embodiment, and it includes all the equivalent techniques that are encompassed by the scope of the following claims.

In particular, the number of bosses of the peripheral edge 23 is not limited.

The bosses of the edge 23 can have any appropriate form, such as that of a prism, a portion of a sphere, a cylinder, a cone or other.

The bosses (or protrusions) could be arranged on the peripheral edge (or side) 20 of the pad 12.

The notches, such as the notches 35, 36, are not indispensable.

The presence of the cavity 37 is not indispensable.

The plate demarcating the upper surface 16 and the lower surface 17 could have a continuous aspect, i.e., with some material connecting the portions tabs 25, 26, 27, 28, 29, 30.

Each pad 12, 13 can have an appropriate form, such as that of an ellipse, a circle, a polygon or other.

The cavity (or opening) 15 could have a closed end and the mounting of the pad could be done on the side of the upper surface 31.

Further, the means allowing a removable fastening of the pad 12 can have a different structure than the one using bosses. For example, nails could extend through the pad 12 between the surfaces 16 and 17 to be driven into the base 4. In this case, the nail heads face the board 3. To remove the pad 12 from the device 1 or to place it thereon, it is not necessary to remove the nails. Indeed, the flexibility of the pad 12 allows it to be deformed in order to allow the nail heads to extend through the constitutive material of the pad 12. Further, the nails and the base 4 can be of one single piece.

It is also possible to achieve the invention as shown in FIG. 5.

According to this alternative embodiment, the device has a pad 40 and a base 41. The pad 40 has two bosses 42, 43 provided to be housed in two cavities (opening) 44, 45, respectively, of the base 41. A retaining means 46 and a disk 47 are used to retain a boot on the base 41 and to retain the base 41 on a board, respectively.

The pad 40 has an opening 48 allowing the disk 47 to cooperate with the board to retain the base 41.

The pad 40 has an upper surface 49 on which the base 41 take support when the latter is retained on the board. This means that when the device is retained on the board, the base 41 is not in contact with the board, because the base 41 take support on the pad 40.

Only a lower surface 50 of the pad 40, opposite to the upper surface 49 with respect to the thickness of the pad 40, comes into contact with the board.

When the device is assembled, the bosses 42, 43 project with respect to an upper surface 51 of the base 41. This allows the bosses 42, 45 to touch the boot sole to absorb the impacts or vibrations of the boots with respect to the device. More than two bosses could be provided in an alternative embodiment, to contact the boot side.

Each of the peripheral edges 52, 53 of the cavities 44, 45 has fastening means shown in the form of bosses (or protrusions) 54, 55, 56 and 57.

The instant application is based upon French Patent Application No. 98 01265, filed Jan. 30, 1998, the disclosure of which is hereby expressly incorporated by reference thereto in its entirety, and the priority of which is hereby claimed under 35 USC 119.

What is claimed is:

1. A device for retaining a boot on a gliding board, the device comprising:

a base having an upper surface positionable to receive a sole of the boot, a lower surface positionable to face a topside of the gliding board, and at least one opening extending though said base between said upper surface and said lower surface;

at least one pad removably housable within said at least one opening, wherein when said at least one pad is housed in said at least one opening, said at least one pad projects upwardly beyond said upper surface of said base; and a fastening system allowing removable connection of said at least one pad in said at least one opening, said fastening system comprising at least one tab portion radially extending from said at least one pad and at least one recess formed in said lower surface of said base and positioned adjacent to said at least one opening for receiving said at least one tab when said at least one pad is housed within said at least one opening.

2. The device according to claim 1, wherein said at least one pad further comprises at least one boss having a boot contact surface; and a plate connected to a lower portion of an outer peripheral side of said at least one boss, said plate forming said at least one tab portion, including an upper surface adapted to contact said base and a lower surface adapted to contact the gliding board.

3. The device according to claim 1, wherein said at least one tab portion includes a plurality of tab portions radially projecting from and circumferentially spaced along an outer peripheral side of said at least one pad;

said plurality of tab portions being separated from each other by at least one receiving notch housed within said outer peripheral side of said at least one pad.

4. The device according to claim 3, wherein said at least one recess formed in said lower surface of said base comprises a plurality of recesses adapted to respectively receive said plurality of tab portions.

5. The device according to claim 3, wherein said fastening system further comprises at least one protrusion that projects from an inner peripheral side of said at least one opening, wherein said at least one protrusion is adapted to interfit with said at least one receiving notch.

6. The device according to claim 3, wherein said plurality of tab portions have varying circumferential lengths.

7. The device according to claim 1, wherein said at least one pad has an inner cavity exposed from the underside of said at least one pad which provides a hollow area throughout said at least one pad.

8. The device according to claim 1, wherein said base is made of a substantially rigid material and wherein said at least one pad is made of a substantially flexible material.

9. A device for retaining a boot on a gliding board, the device comprising:

a base having upper and lower sides, said upper side adapted to receive the sole of the boot and said lower side adapted to interface with a topside of the gliding board, said base having at least one opening extending through said base between said upper and lower sides, wherein said at least one opening is adapted to house at least one pad;

said at least one pad having a boot contact surface which projects upwardly beyond said upper side of said base when secured thereto; and a fastening system, comprising, a plurality of tab portions, extending from said at least one pad, adapted to be received by a plurality of recesses;

said plurality of recesses located on said lower side of said base and located adjacent an inner peripheral edge defining said opening;

said fastening system allowing a secured interfitting and removable connection of said at least one pad to said base.

10. The device according to claim 9, wherein said at least one pad comprises an outer peripheral side; and a flange connected to a lower end of said outer peripheral side of said at least one pad, said flange configured in an annular shape, forming said plurality of tab portions, and having an upper surface and lower surface.

11. The device according to claim 10, wherein said plurality of tab portions radially project from and are circumferentially spaced along said outer peripheral side of said at least one pad, said plurality of tab portions being spaced apart from each other by at least one receiving notch, said at least one receiving notch being housed within said peripheral side of at least one pad.

12. The device according to claim 11, wherein said fastening system further comprises at least one projection, which projects from said inner peripheral edge defining said opening of said base, said at least one projection adapted to securely interfit within said at least one receiving notch.

13. The device according to claim 9, wherein said at least one pad has a hollow displaced area exposed from the underside of said pad.

14. The device according to claim 9, wherein said base is made of a rigid material and said at least one pad is made of a flexible and resilient material.

15. The device according to claim 9, wherein said plurality of tab portions have varying circumferential lengths.

16. A device for retaining a boot on a gliding board, the device comprising:

a base having an upper surface positionable to receive a sole of the boot, a lower surface positionable to face a topside of the gliding board, and at least one opening extending though said base between said upper surface and said lower surface;

said at least one pad removably housable within said at least one opening, wherein when said at least one pad is housed in said at least one opening, said at least one pad projects upwardly beyond said upper surface of said base; and a fastening system allowing removable connection of said at least one pad in said at least one opening, said fastening system comprising, a plurality of lower tab receiving recesses located on said lower surface of said base;

at least one protrusion projecting from an inner peripheral edge of said at least one opening; and at least one boss projecting upwardly from said pad having a plurality of tabs adapted to securely interfit with said plurality of lower tab receiving recesses and at least one receiving notch adapted to securely interfit with said at least one protrusion.

* * * * *